US009190204B1

(12) United States Patent
Cates, Jr.

(10) Patent No.: US 9,190,204 B1
(45) Date of Patent: Nov. 17, 2015

(54) MULTILAYER PRINTED CIRCUIT BOARD HAVING CIRCUIT TRACE WINDINGS

(71) Applicant: Marion Harlan Cates, Jr., Birmingham, AL (US)

(72) Inventor: Marion Harlan Cates, Jr., Birmingham, AL (US)

( * ) Notice: Subject to any disclaimer, the term of this patent is extended or adjusted under 35 U.S.C. 154(b) by 0 days.

(21) Appl. No.: 14/683,052

(22) Filed: Apr. 9, 2015

Related U.S. Application Data

(63) Continuation-in-part of application No. 14/273,412, filed on May 8, 2014, now abandoned.

(60) Provisional application No. 61/822,402, filed on May 12, 2013.

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 27/29*** | (2006.01) |

(52) U.S. Cl.
CPC ..... *H01F 27/2804* (2013.01); *H01F 27/24* (2013.01); *H01F 27/29* (2013.01); *H01F 2027/2809* (2013.01)

(58) Field of Classification Search
CPC ..... H01F 5/00; H01F 27/00–27/30
USPC ..... 336/65, 83, 200, 232
See application file for complete search history.

(56) References Cited

U.S. PATENT DOCUMENTS

| | | | | |
|---|---|---|---|---|
| 4,342,976 | A | 8/1982 | Ryser | |
| 4,543,715 | A | 10/1985 | Iadarola et al. | |
| 5,070,317 | A * | 12/1991 | Bhagat | 336/200 |
| 5,781,091 | A * | 7/1998 | Krone et al. | 336/200 |
| 6,583,705 | B2 | 6/2003 | Schutten et al. | |
| 6,990,729 | B2 * | 1/2006 | Pleskach et al. | 29/606 |
| 7,009,486 | B1 | 3/2006 | Goeke et al. | |
| 7,106,162 | B2 * | 9/2006 | Saito | 336/229 |
| 7,158,005 | B2 * | 1/2007 | Pleskach et al. | 336/229 |
| 7,196,607 | B2 * | 3/2007 | Pleskach et al. | 336/200 |
| 7,271,697 | B2 * | 9/2007 | Whittaker et al. | 336/229 |
| 7,352,270 | B1 | 4/2008 | Copeland | |
| 7,375,611 | B1 * | 5/2008 | Pleskach et al. | 336/229 |
| 7,423,884 | B2 | 9/2008 | Enchi et al. | |
| 7,436,282 | B2 * | 10/2008 | Whittaker et al. | 336/200 |
| 7,602,272 | B2 * | 10/2009 | Whittaker et al. | 336/200 |
| 8,072,308 | B2 | 12/2011 | Aboumrad et al. | |
| 8,466,769 | B2 * | 6/2013 | Dalmia et al. | 336/200 |
| 8,591,262 | B2 * | 11/2013 | Schaffer et al. | 439/620.18 |
| 9,048,021 | B2 * | 6/2015 | Duplessis et al. | |
| 2006/0109071 | A1 | 5/2006 | Thongsouk et al. | |

* cited by examiner

*Primary Examiner* — Tuyen Nguyen

(74) *Attorney, Agent, or Firm* — Gerald M. Walsh; Leo Law Firm, LLC

(57) ABSTRACT

A multilayered printed circuit board with circuit trace windings having two or more top layers, two or more bottom layers and one or more intermediate layers therebetween, forming a hollow interior within the circuit board. The layers have wireless electrically conducting holes. Electrical circuit traces connect one hole to another hole, thereby forming two or more sets of wireless circuit trace windings (coils) around the hollow interior. Each set of windings has its own separate pair of a top layer and a bottom layer. When a metal core is positioned in the hollow interior a wireless transformer can be formed having a primary coil and one or more secondary coils. Because the coils are concentric sufficient windings can be achieved to produce adequate magnetic flux for power transfer.

13 Claims, 10 Drawing Sheets

MULTILAYER PRINTED CIRCUIT BOARD HAVING CIRCUIT TRACE WINDINGS

CROSS-REFERENCE TO RELATED APPLICATIONS

This application claims priority of U.S. Provisional Application Ser. No. 61/822,402 filed May 12, 2013, and U.S. patent application Ser. No. 14/273,412 filed May 8, 2014, the disclosures of which are incorporated herein by reference.

FIELD OF THE INVENTION

The present invention relates to transformers and, more particularly, to wireless transformers imbedded in multilayer printed circuit boards having circuit trace windings.

BACKGROUND OF THE INVENTION

Current mass-produced transformers are generally made by winding insulated wire around a bobbin, with a hollow core. The bobbin is generally nonconductive and is a spool that allows the winding of different sized wire in the center of the bobbin/spool. This bobbin is similar to bobbins used on a sewing machine.

One wire size is wound around until the number of needed turns is made for the first wire generally called the primary. The ends are brought out so they can be mounted on a firm base later on. Next another winding, called a secondary is wound on top of the primary winding or sometimes on a second bobbin. When enough wire turns are wound the spool is complete and the wires for the secondary winding are mounted for easy attachment. The primary windings are for the incoming AC voltage and the secondary is for the output AC voltage. In general the ratio of the primary to the secondary windings determines the increase or decrease in AC voltage in the transformer.

When the windings on the bobbin are completed, it is desirable to have a continuous core that surrounds the windings and passes through the center hole in the bobbin. This is normally accomplished by forming pieces of flat metal cut so that layers of the core material can be laminated around the windings, making a jigsaw like pattern held together physically or with glue. The wire mountings are then labeled.

This is a general method for mass producing transformers, requiring multiple steps, some of which require hand assembly. The process must be closely controlled to insure desired results and there are many places where the windings can be broken, the number of windings can vary, and/or the placement of the wires will vary slightly. The wire insulation must not be damaged and other manufacturing techniques must be exact to achieve the desired results.

Power distribution systems usually require miles of cabling, transformers mounted on stationary or movable platforms, and various other electrical equipment systems. The power transformer is required to reduce voltage levels from high transmission levels to usable lower levels. For example, power distribution systems for coal and other horizontal mines are required to provide electricity for mining machines, lighting, ventilation, safety, transportation, and other needs.

Current transformers used in the mines are virtually identical in form and function to those used in commercial power grids. These transformers are of various types, but typically they consist of wire wound around a metal or magnetic susceptible core. A large number of windings on the primary input coil are used to induce a lower voltage using fewer windings in a secondary output coil. This reduction in voltage typically is accompanied by a power loss in the form of heat. The heat is normally dissipated by using a cooling fluid around the core/windings.

Heat is the ruin of transformers because of lost power, degradation of the wiring insulation, and reduction in the life and performance of the transformer. The fluid cooling systems on the transformer add significantly to its weight and size, making the transformer bulky, difficult to handle especially in underground applications. Further, the cooling fluids can overheat causing rupture of the cooling vessels. The loss of the cooling fluids quickly hastens failure of insulation, causing transformer failure and possible fire. Constant maintenance on the transformer systems is needed making the cost of operating the transformers expensive. What is needed are smaller transformers that have high efficiency cores and thick insulation that can tolerate higher temperatures and that can work over a much higher temperature range and with much fewer failures when overloaded, compared to existing transformers.

Printed circuit boards provide good insulation and have circuit traces in combination with vias. U.S. Patent Application No. 20060109071 discloses a three-layered printed circuit board having one top layer, one middle layer, and one bottom layer with circuit traces on the top and bottom layers. The top and bottom layers are laminated to the middle layer which contains an amorphous metal or other magnetically susceptible core therein. Traces on the top layer, traces on the bottom layer, and conductive vias through all the layers form a single coil around the core. A current through the coil creates a magnetic field in the core, which can be used to couple one or more signals together through magnetic flux. To increase the level of the signal, more windings would be required, since the magnetic field strength is proportional to the number of windings around the core. In the Motorola design, the coil is limited to a single layer, so a larger number of windings (turns) in a coil would have to be physically spread out over a large area rather than lying on top of each other as in a transformer. Spreading the coil over a large area would limit the magnetic flux that can be generated in the core. To add more windings the core would have to be extended, which reduces the magnetic field in any cross-section of the core for any specific signal, voltage or current.

In typical transformer designs, multiple windings are laid concentrically with sufficient turns so that the required magnetic flux is obtained in the core. Having only a single layer of windings greatly limits the amount of magnetic flux that can be induced in a core. The magnetic field generated by the primary windings surrounding the core transfer energy to the secondary windings with high efficiency. The ratio of the number of input windings to the output windings, called the turns ratio, determines the voltage change and current availability at the output. The product of the current and voltage at the input and output are identical for an ideal transformer. With proper selection of the turns ratio, voltage levels can be increased at the expense of current, or current levels can be increased at the expense of voltage. Total energy is always conserved between the input and output windings.

The design in U.S. Patent Application No. 20060109071 is severely limited in the number of turns that can be made around the core for any given distance of core. As a result this design cannot be used to generate a magnetic field for attracting, repelling, or inducing magnetic fields to perform work. This design, having only a single layer of windings on a core, cannot provide the power needed for such devices as transformers and the like. With regard to using a circuit board design for a transformer, what is needed is a design that will allow multiple windings laid concentrically with sufficient turns so that the required magnetic flux is obtained in the core to produce useful power transfer.

SUMMARY OF THE INVENTION

The present invention provides multilayered printed wireless circuit boards having circuit trace windings. The multilayered printed circuit board has two or more top layers, two or more bottom layers and, one or more intermediate layers therebetween. Each intermediate layer has an open interior so that the top layers, the bottom layers, and the intermediate layers form a hollow interior within the multilayered printed circuit board. Each of the top layers, bottom layers, and intermediate layers have a plurality of electrically conducting holes wherein, when one of the electrically conducting hole contacts another electrically conducting hole, an electrical conducting connection is made therebetween. There are electrical circuit traces on the top layers and the bottom layers. The electrical circuit traces connect one electrically conducting hole to another electrically conducting hole. The electrical circuit traces form connections across the top layers and the bottom layers. The electrically conducting holes form electrical connections between the top layers, the intermediate layers, and the bottom layers, thereby forming two or more sets of wireless windings around the hollow interior. Each set of wireless windings has its own top layer and bottom layer. Two or more sets of wireless windings may be connected in series to form a single set of wireless windings.

A metal core can be positioned in the hollow interior and may be completely embedded within the multilayered printed circuit board. A transformer is thereby formed having at least one set of primary windings and at least one set of secondary windings around the metal core. Two of the multilayered circuit boards, each having a core, wherein the cores are joined to form a continuous core, together may form a transformer with one of the circuit boards having at least one set of primary windings around its metal core and with other circuit board having at least one set of secondary windings around its metal core. The multilayered printed circuit board can have a circular shape with the metal core therein also having a circular shape, thereby forming a toroidal transformer. These transformers can have one or more taps extending from one or more conducting holes or from one or more electrical circuit traces. For example, a single tap on a secondary coil can provide power to an array of light emitting diodes (LEDs) or multiple taps on a secondary coil can provide power to a parallel LED array.

An advantage of the present invention is a transformer formed in a multilayered printed circuit board which has no wires and uses circuit traces and electrically conducting holes to form sets of wireless circuit trace windings around a metal core.

Another advantage of is a transformer formed in a multilayered printed circuit board in any desired shape, such as thinner transformers with improved fluidless cooling, which can equate to any current transformer design.

Another advantage is that all types of transformers can be made with the multilayered circuit board of the present invention and all of these transformers can have solid cores.

Another advantage is improved insulation provided by spacing on the circuit board and by the laminating layers of the multilayered circuit board.

Another advantage are transformers that can have high efficiency cores and thick insulation that can tolerate higher temperatures than existing transformers.

Another advantage are circuit trace windings which are closer to the metal core, i.e., in a higher magnetic flux, compared to windings formed with wires.

Another advantage is a wireless transformer that can work over a much higher temperature range and with much fewer failures when overloaded, compared to transformers constructed of wire windings.

Another advantage is circuit trace windings that are scalable from very small to very large which can be used for transformers, inductors, solenoids, antennas, resistors, chokes, and the like and which can be manufactured by known methods, including 3D printing technology.

Another advantage is the ability to use printed circuit boards of varying shape or geometry for electronic designers to make specialty circuits with novel electrical applications. Examples of such devices include curved cores and transformers, flexible transformers, impedance matching transformers built inside of circuit boards, inductors, windings/coils matching specific magnetic fields, and the like which would not be feasible with existing devices.

DETAILED DESCRIPTION OF THE INVENTION

Figure 1A:
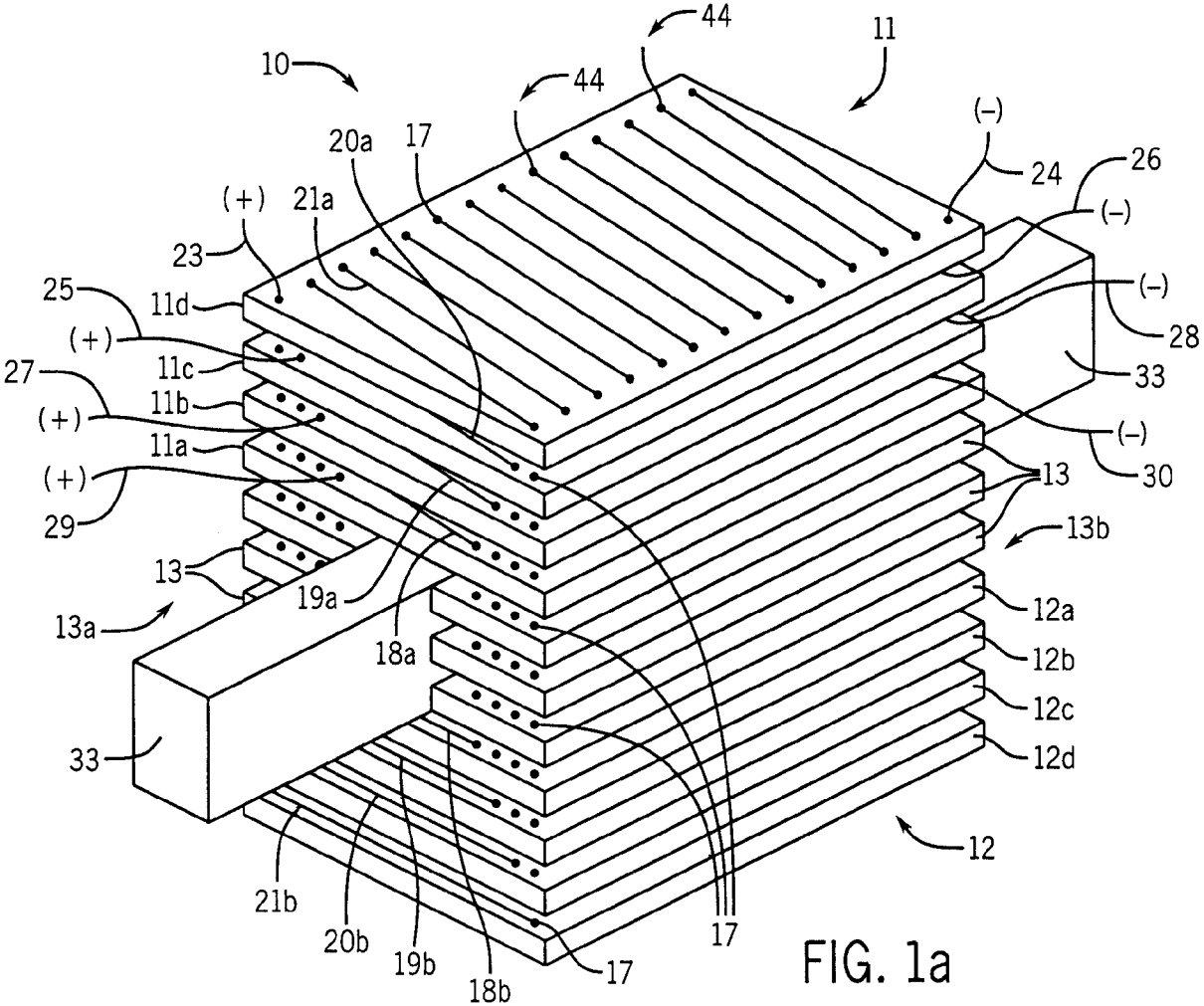
FIG. 1*a* illustrates an exploded cut-away view of a multilayered printed circuit board of the present invention.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

The present invention provides a transformer within a multilayered printed circuit board. The method of making this transformer uses modern multilayer circuit board manufacturing techniques. These techniques allow etching copper circuit traces into different layers of a multilayered circuit board, then joining the different layers together using blind and normal plaited through holes, having electrically conducting material therein, to complete the winding. The metal core is placed inside the multilayered circuit board during assembly and becomes buried inside the multilayered circuit board. The height of the copper circuit traces is less than with wires because the copper circuit trace cross-section is rectangular instead of round, as in a wire. Insulation is provided by spacing on the circuit board and by the laminating layers of the multilayered circuit board. The laminating layers provide many times the thickness of insulated coatings on wires. Because the circuit traces are held in place by the circuit board, the circuit traces are more secure and less prone to heating/cooling cycle breaks compared to wires. If high temperature materials are used for the multilayered circuit board, the transformer can work over a much higher temperature range and with much fewer failures when overloaded, compared to transformers constructed of wire windings. Because the metal circuit traces are flat they will be closer to the metal core material, which improves the efficiency of the transformer, compared to the use of wire coils (sets of windings). Because the circuit trace windings are closer to the metal core they create a higher magnetic flux, compared to windings formed with wires.

The entire process of assembly can be carried out using current circuit board manufacturing techniques. When combined with a pick and place machine to insert the core at the correct point in the manufacturing process, the parts should be of higher quality and cheaper in quantity, as a result of reducing manual labor associated with transformer manufacture. The transformers of the present invention will be much more identical in performance than current methods can achieve. This multilayered circuit board design easily allows multiple taps, providing connections to the windings at various points for different voltages, which should give circuit designers a variety of new ways to construct electronic devices.

The same techniques can be used to make chokes, inductors, antennas, and other similar components in a multilayered circuit board, which will lower the cost of assembly and parts and provide custom parts for specific designs. Ceramic, glass, Teflon, or other materials can be used to create special parts and transformers for multiple uses. A ceramic transformer, bonded with ceramics, would allow transformers to operate at temperatures up to the melting point of the conductors, i.e. copper.

This multilayer printed circuit board having circuit trace windings is scalable from very small, to very large. On the small scale, transformers can be made micro-sized using integrated circuit manufacturing techniques, allowing for coupling and matching of frequency signals between parts. On the large scale, high power transformers can be made that can operate at higher temperatures, thereby lowering costs and reducing failure rate in power transmission.

Figure 3:
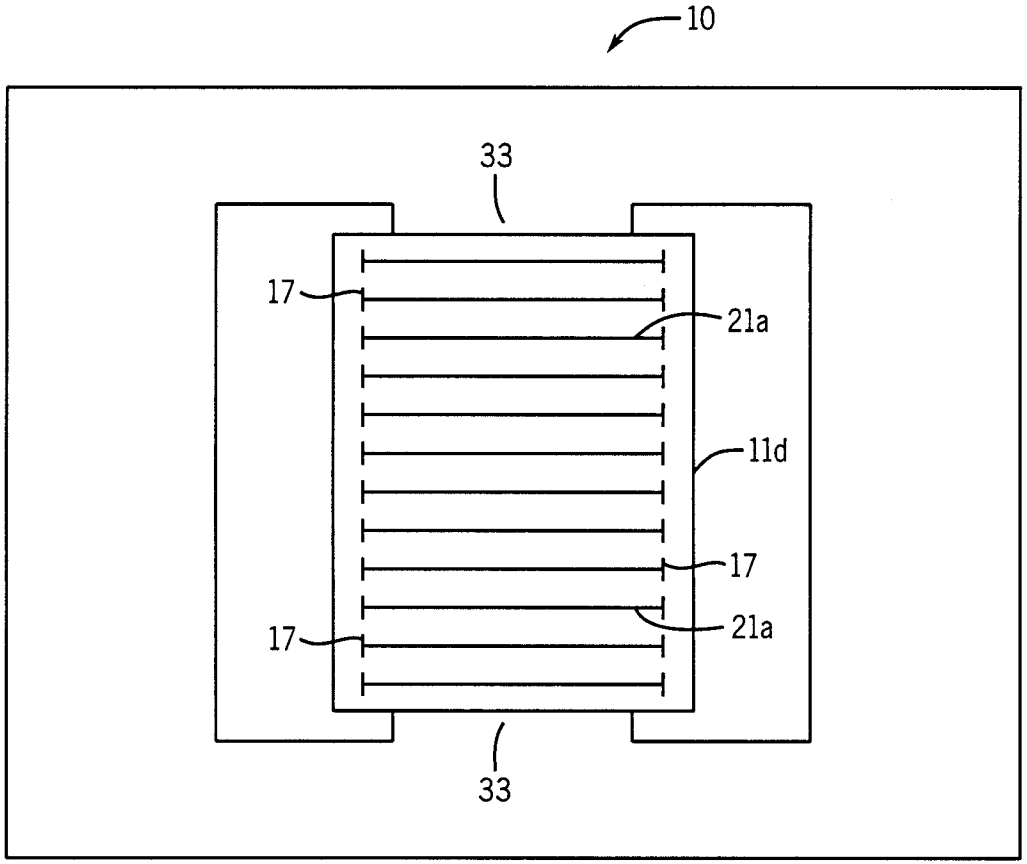
FIG. 3 shows a top view of the multilayered printed circuit board of FIG. 1*a* wherein the metal core extends out of the circuit board and encircles the circuit board.

FIG. 1*a* illustrates an exploded, cut-away view of a multilayered circuit board 10 of the present invention. First layer 11*a*, second layer 11*b*, third layer 11*c*, and fourth layer 11*d* are top layers 11 of the circuit board 10. First layer 12*a*, second layer 12*b*, third layer 12*c*, and fourth layer 12*d* are bottom layers 12 of the circuit board 10. Intermediate layers 13 are positioned between the top layers 11*a*-11*d* and the bottom layers 12*a*-12*d*. The top layers 11, the bottom layers 12, and the intermediate layers 13 form a hollow interior 16 (see FIG. 1*c*) within the multilayered circuit board 10. A magnetically inducible metal core 33 is shown positioned in the hollow interior 16. Although FIG. 1*a* shows the circuit board 10 having 4 top layers 11, 4 bottom layers 12, and 3 intermediate layers 13, the number of these layers can be varied as desired. Each layer has a plurality of holes or channels 17 having electrically conducting material, preferably copper, contained therein, similar to circuit traces (blind or plated through holes or electrically conducting holes). When one electrically conducting hole 17 comes into contact with another electrically conducting hole 17 an electrical connection is made through the electrically conducting holes 17. Thus, the electrically conducting holes 17 provide electrical connections down through the top layers 11, the intermediate layers 13, and the bottom layers 12. Electrical circuit traces 18*a*, 19*a*, 20*a*, and 21*a* are shown on the top layers 11. Electrical circuit traces 18*b*, 19*b*, 20*c*, and 21*d* are shown on the bottom 12 layers. The traces connect one electrically conducting hole 17 to another electrically conducting hole 17 by forming connections across the top layers 11 and the bottom layers 12. Since the electrically conducting holes 17 form electrical connections between the top layers 11, the intermediate layers 13, and the bottom layers 12, the combination of the electrical traces and the electrically conducting holes can form one or more sets of wireless windings (coils) around the hollow interior 16 and around the metal core 33. In FIG. 1*a* there are four separate coils. The middle layers 13 have no traces. One of the electrically conducting holes 17 on the top layers 11 can have AC in leads 23 (fourth coil), 25 (third coil), 27 (second coil), and 29 (first coil) attached thereto, and another of the electrically conducting holes 17 on the top layers 11 can have AC out leads 24 (fourth coil), 26 (third coil), 28 (second coil), and 30 (first coil) attached thereto. Leads can also extend from the bottom layers 12 if desired. An electrical tap connection 44 can be positioned anywhere on any trace or any electrically conducting hole 17. Although FIG. 1*a* shows a liner metal core positioned in the interior 16 of the middle layers 13, a metal core can extend out of the interior 16 and can have a rectangular shape as shown in FIG. 3. The multilayered circuit board 10 can be constructed to function as an antenna, an inductor, an electromagnet, a solenoid, or a transformer.

Figure 1B:
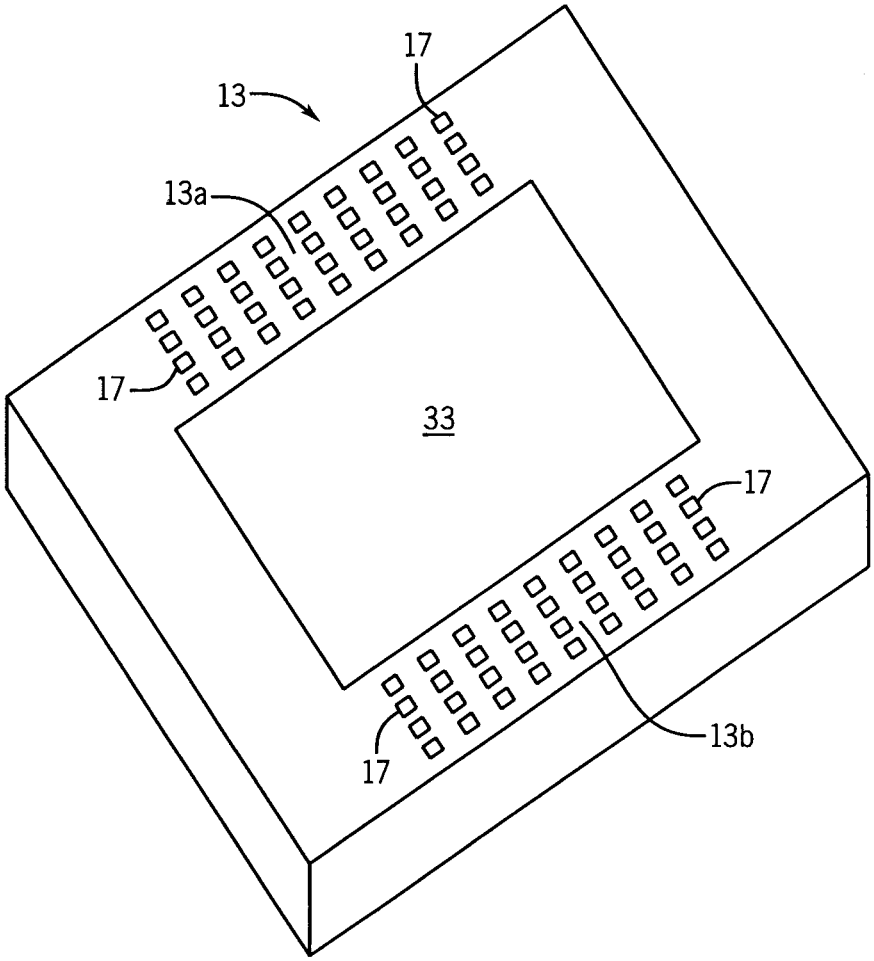
FIG. 1*b* shows a middle layer of the multilayered printed circuit board of FIG. 1*a* that is constructed to completely enclose a hollow interior of the of the circuit board which contains a core.

FIG. 1*b* shows that intermediate layer 13 can be rectangular in shape having a first side 13*a* and a second opposite side 13*b* with a space therebetween, creating a hollow interior 16 (see FIG. 1*c*) with a metal core 33 therein. Sides 13*a* and 13*b* have electrically conducting holes 17 which are in alignment with those of top layers 11*a*-11*d* and bottom layers 12*a*-12*d* (see FIG. 1*a*). FIG. 1*b* shows that the metal core 33 in the hollow interior 16 can be enclosed by the middle layer 13 so that the core 33 can be completely enclosed by top layers 11*a*-11*b*, middle layers 13, and bottom layers 12*a*-12*b*. The metal core 33 can also have a circular shape encased by top layers 11*a*-11*b*, middle layers 13, and bottom layers 12*a*-12*b* constructed to conform to the shape of a circular core, as shown in FIGS. 4 and 5.

Figure 1C:
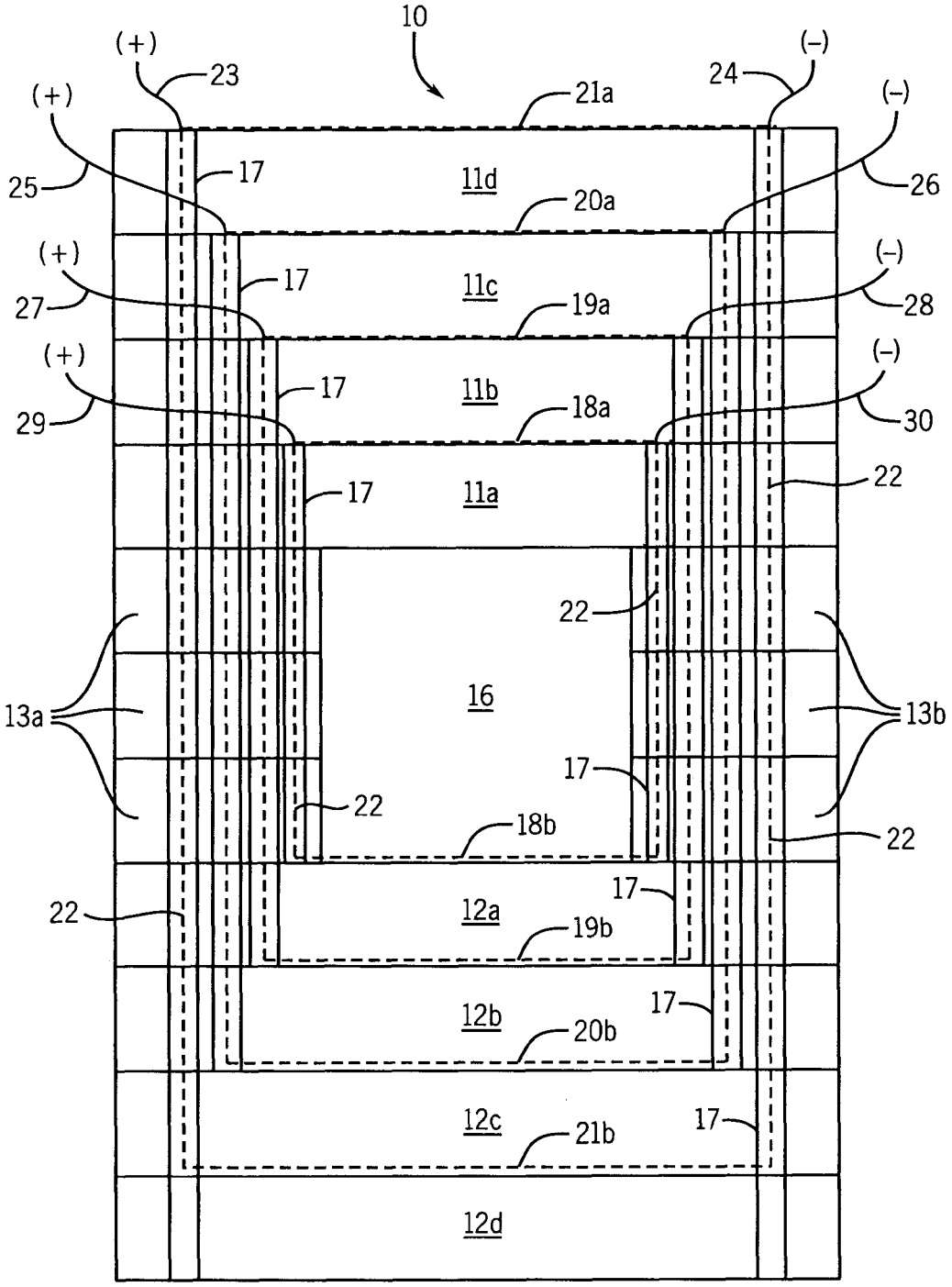
FIG. 1*c* shows a vertical cross sectional front view of the multilayered printed circuit board of FIG. 1*a* with layers assembled and in contact with each other.

FIG. 1*c* shows a vertical cross sectional view of the multilayered circuit board 10 with layers assembled and in contact with each other. The circuit traces 18*a*-18*b*, 19*a*-19*b*, 20*a*-20*b*, and 21*a*-21*b* are shown in dashed lines. Also shown in dashed lines is electrical conducting material 22 in the electrically conducting holes 17. The electrical circuit traces 18*a*-18*b*, 19*a*-19*b*, 20*a*-20*b*, and 21*a*-21*b* form horizontal electrical connections with the electrically conducting holes 17. The electrical conducting material 22 in the electrically conducting holes 17 form vertical electrical connections. The electrical traces 18*a*-18*b*, 19*a*-19*b*, 20*a*-20*b*, and 21*a*-21*b* on the top 11 and bottom 12 layers, respectively, in combination with the electrically conducting holes 17, each form a plurality of coils having loops or windings around the central hollow section 16. The electrical traces 18*a*-18*b*, 19*a*-19*b*, 20*a*-20*b*, and 21*a*-21*b* can continue from the front of their respective layers to the rear their respective layers, connecting with electrically conducting holes 17, to form coils around the central hollow section 16. The traces 18*a*-18*b*, 19*a*-19*b*, 20*a*-20*b*, and 21*a*-21*b*, which are in a concentric configuration, each form a separate set of windings or a separate coil. In making a transformer traces 18*a*-18*b* may form a primary coil and traces 19*a*-19*b*, 20*a*-20*b*, and 21*a*-21*b* may form three secondary coils with three separate outputs. However, the separate coils could be connected in series to form one large set of windings or one large coil (see FIG. 2). It can be seen from FIGS. 1*a* and 1*c* that one pair of top 11 and bottom 12 layer are required to make one set of windings or a coil, i.e., each set of windings or coil has its own pair of a top layer 11 and a bottom layer 12. The number of the pairs of top 11 and bottom 12 layers can be varied as desired to produce any number of coils or sets of windings.

Figure 2A:
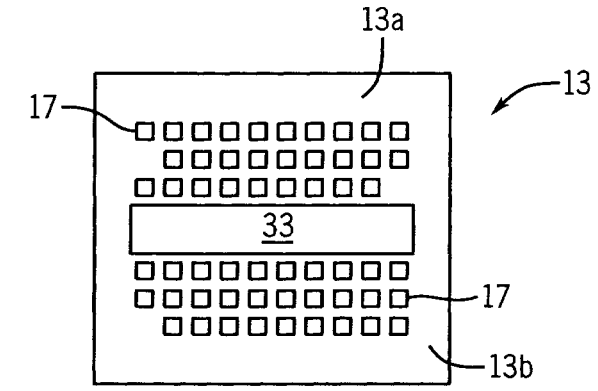
FIGS. 2*a*-2*d* show a middle layer and three top layers of the multilayered circuit board of FIG. 1*a*, illustrating three separate layers of coils connected in series.

FIGS. 2*a*-2*d* illustrate, in more detail, a single middle layer 13 and 3 top layers 11*a*-11*e* of FIG. 1*a*. FIG. 2*a* shows the middle layer 13 with its electrically conducting holes 17 which are constructed to align with those of top layers, such as 11*a*-11*e* for example.

Figure 2B:
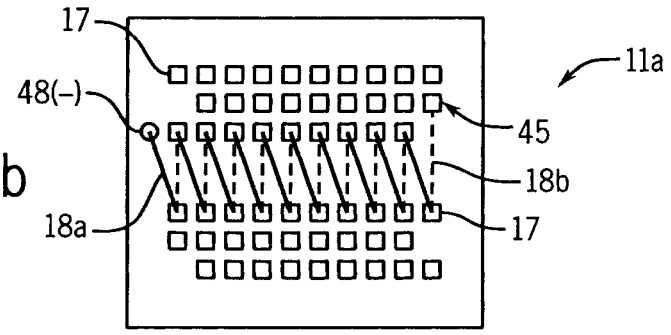

FIG. 2*b* shows first top layer 11*a* with traces 18*a*. Traces 18*a* are shown connecting with traces 18*b* (shown as dashed lines) on a first bottom layer 12*a* (not shown) through the connecting holes 17 of first top layer 11*a*, middle layer 13, and first bottom layer 12*a* (not shown). FIG. 2*b* further shows that a 18*b* trace can extend to connecting hole 17, shown at 45, to connect in series with a trace 19*a* when first top layer 11*a* is positioned on top of middle layer 13 and second top layer 11*b* is positioned on top of first top layer 11*a*.

Figure 2C:
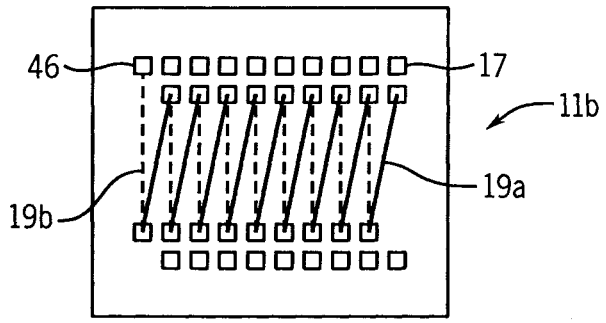

FIG. 2*c* shows second top layer 11*b* with traces 19*a*. Traces 19*a* are shown connecting with traces 19*b* (shown as dashed lines) on bottom layer 12*b* (not shown) through the connecting holes 17 of second top layer 11*b*, first top layer 11*a*, middle layer 13, first bottom layer 12*a* (not shown) and second bottom layer 12*b* (not shown). FIG. 2*c* further shows that a 19*b* trace can extend to connecting hole 17, shown at 46, to connect in series with a trace 20*a* when first top layer 11*a* is positioned on top of middle layer 13, second top layer 11*b* is positioned on top of first top layer 11*a*, and third top layer 11*c* is positioned on top of second top layer 11*b*.

Figure 2D:
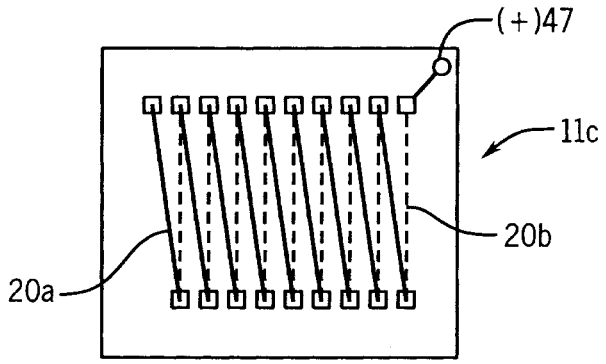

FIG. 2*d* shows third top layer 11*c* with traces 20*a*. Traces 20*a* are shown connecting with traces 20*b* (shown as dashed lines) on third bottom layer 12*c* (not shown) through the connecting holes 17 of third top layer 11*c*, second top layer 11*b*, first top layer 11*a*, middle layer 13, first bottom layer 12*a* (not shown), second bottom layer 12*b* (not shown), and third bottom layer 12*c* (not shown). FIG. 2*d* further shows that a trace 19*b* connects in series with a trace 20*a* as described for FIG. 2*c*. In this configuration coils 18*a*-18*b*, 19*a*-19*b*, and 20*a*-20*b* are shown connected in series, forming a single coil, having a positive lead 47 at the free end of coil 20*a*-20*b* and a negative lead 48 (FIG. 2*b*) at the free end of coil 18*a*-18*b*.

FIG. 3 shows a top view of the multilayered printed circuit board of FIG. 1*a* wherein the metal core extends out of the circuit board and encircles the circuit board. This configuration is suitable for the formation of a transformer having a primary and secondary coil in a multilayered printed circuit board.

Figure 4A:
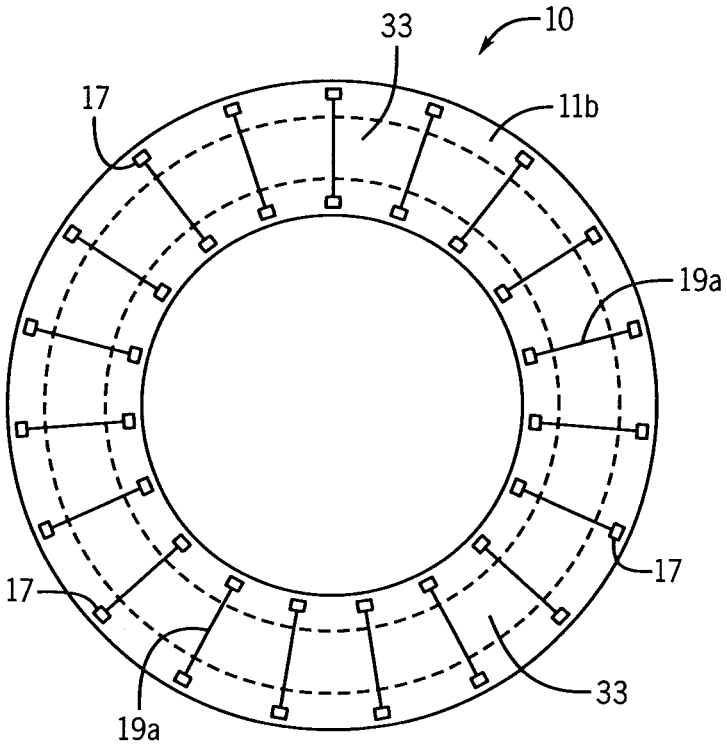
FIG. 4*a* shows a top view of the multilayered printed circuit board of FIG. 1*a* in which the circuit board is constructed in a continuous circular configuration.
Figure 4B:
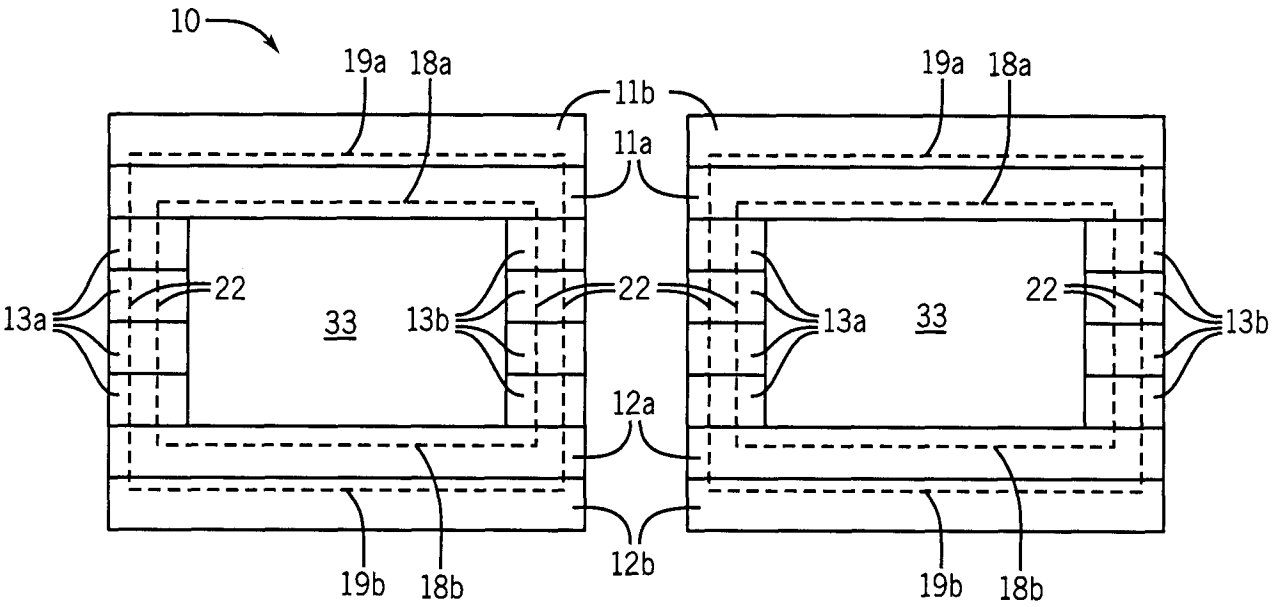
FIG. 4*b* shows a cross-sectional view through the circuit board of FIG. 4*a*.
Figure 5:
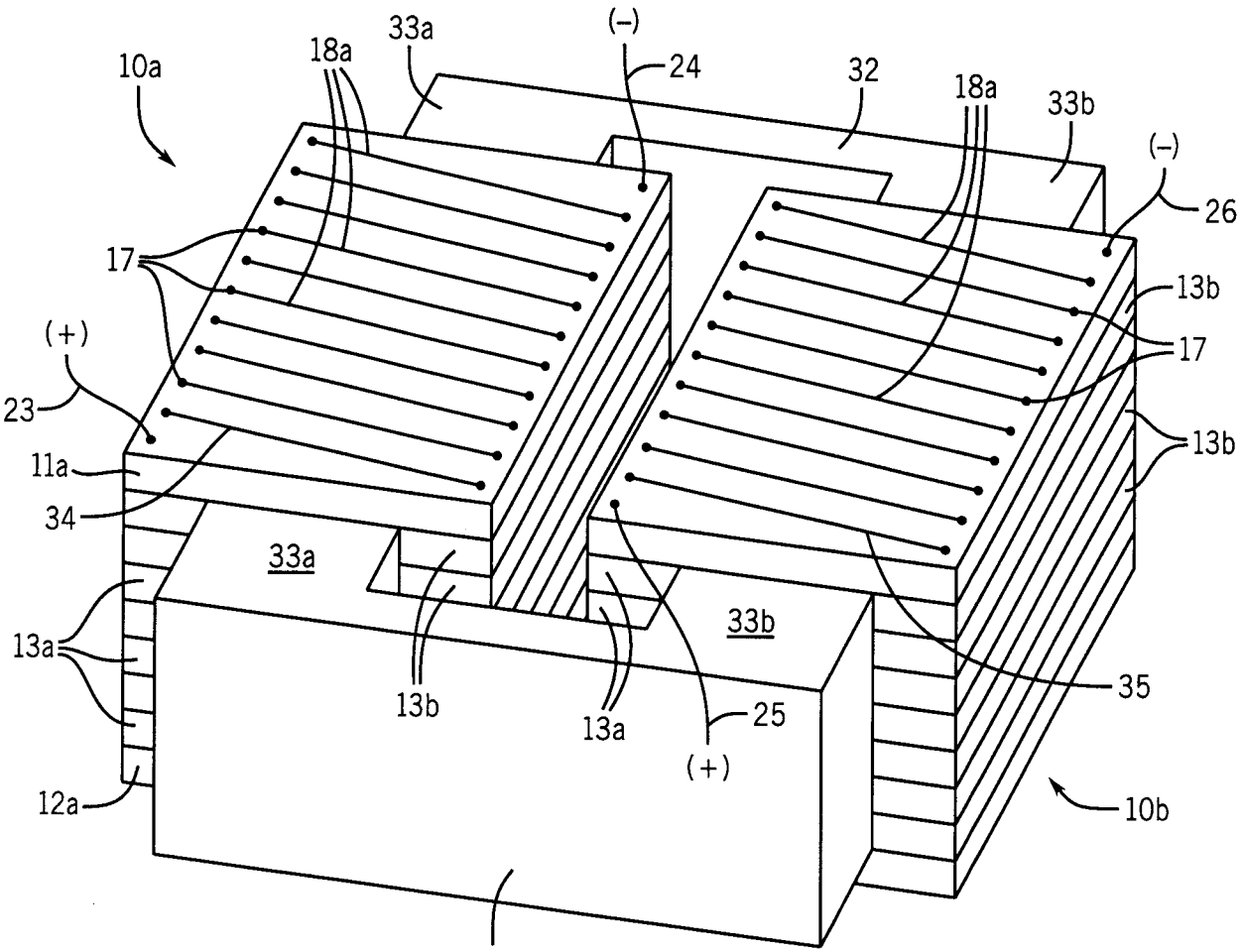
FIG. 5 shows a pair of multilayered printed circuit boards of FIG. 1*a* adjacent to each other with their cores connected so as to form a continuous core.

FIG. 4*a* shows a top view of the multilayered printed circuit board 10 of FIG. 1*a* in which the circuit board is constructed in a continuous circular configuration. The core 33 is also in a circular configuration. FIG. 4*b* shows that, constructed in this manner with a primary coil 18*a*-18*b* and a secondary coil 19*a*-19*b*, the multilayered printed circuit board forms a toroidal transformer.

FIG. 5 shows a pair of multilayered printed circuit boards 10 of FIG. 1*a* adjacent to each other with their cores 33*a* and 33*b* connected so as to form a continuous core 32. The coil 18*a*-18*b* in one of the circuit boards 10*a* can act as a primary coil and another coil 18*a*-18*b* in the other circuit board 10*b* can act as a secondary coil, thereby forming a transformer. The circuit boards 10*a* and 10*b* can be joined to form a single circuit board.

Figure 6:
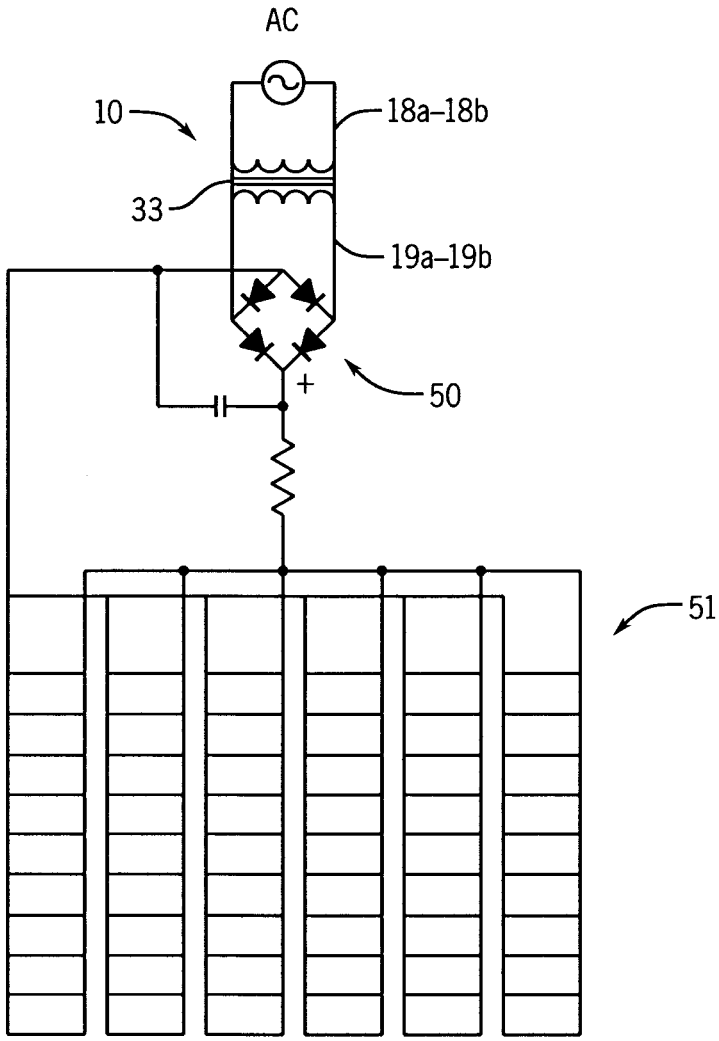
FIG. 6 shows a diagram illustrating the use of a multilayered printed circuit board of the present invention constructed as a transformer providing power to an array of light emitting diodes (LEDs).

FIG. 6 shows a diagram illustrating the use of a multilayered printed circuit board 10, constructed as a transformer, with a primary coil 18*a*-18*b* and a secondary coil 19*a*-19*b*, providing power to an array 51 of light emitting diodes (LEDs). The secondary coil 19*a*-19*b* of the transformer 10 is shown connected to a bridge rectifier 50 which is then connected to LED array 51.

Figure 7:
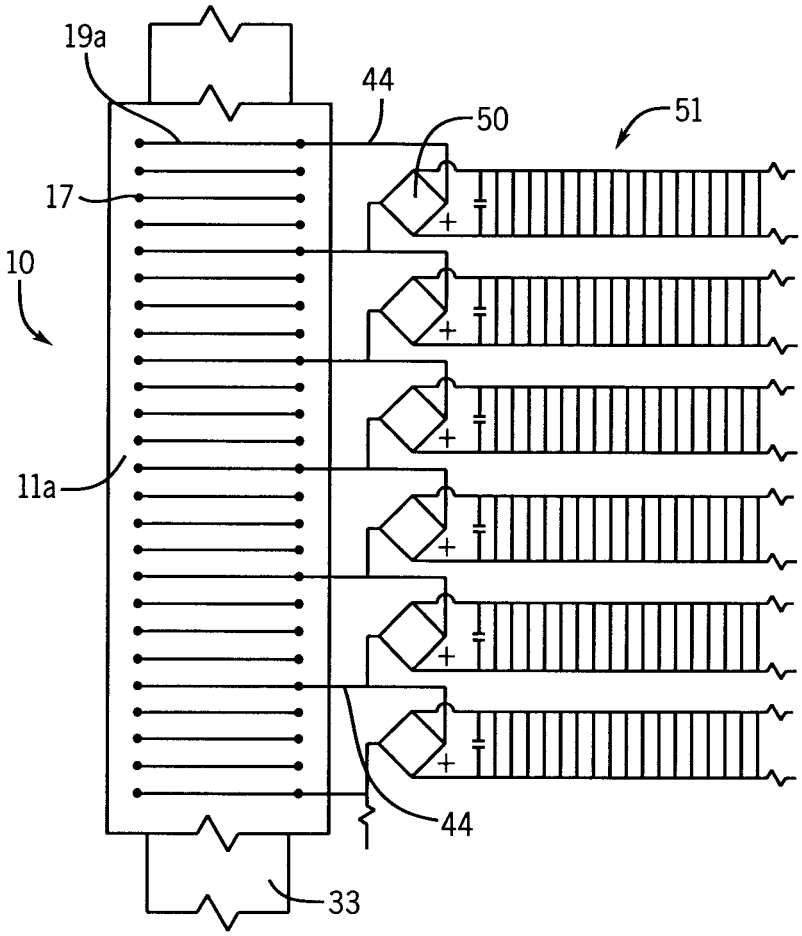
FIG. 7 shows a diagram illustrating the use of a multilayered printed circuit board of the present invention, constructed as a transformer having multiple taps on a secondary coil, to provide power to a parallel LED array.

FIG. 7 shows a diagram illustrating the use of a multilayered printed circuit board 10 of the present invention, constructed as a transformer having multiple taps 44 on a secondary coil 19*a*-19*b*, to provide power to a parallel LED array 51.

The multilayered circuit board having a metallic core therein may be made using existing manufacturing techniques with minimal labor and will be cheaper than exiting transformers. The layers can have a thickness as little as 0.0027 inches. The traces can have a thickness as little 0.001 inches and a width as little as 0.005 inches. Thus, 5 top layers having traces could have a thickness, for example, as little as 0.0185 inches (0.47 mm). DuPont™ Pyralux® flexible laminates are suitable for forming the layers of the circuit board. A transformer made of these 5 top layers, 5 similar bottom layers, and one intermediate layer of 0.0027 inch thickness would have a total thickness of about 0.04 inches (1 mm) and would provide one primary coil and 4 secondary coils.

These transformers can have higher efficiency cores and thicker insulation and can tolerate high temperatures compared to existing transformers. The winding insulation will be greater and more robust than with existing transformers that use wires, which adds greatly to transformer life and to resistance to such factors as over-voltage, over-current, surges, temperature changes, and the like. The metal core can be of a high performance core material that is thin, about the thickness of a normal circuit board, mounted in an internal layer of the multi-layer circuit board. The manufacturing process for the transformer in the multilayer circuit board may be in two or three parts. For example, the intermediate layers of the circuit board can be made leaving a hole/opening for the core. The core can be positioned in the hole using a parts insertion machine. The top and bottom layers can be added providing all the connections and windings around the core. The completed board can be coated to seal the circuit board and provide insulation. Heat sink fins may be used for high current loads. Trace thickness can be varied as desired and multiple taps may be made available for various voltage/current combinations. The layers can be made from metal-plated ceramic materials, Teflon, silicon carbide, or any material with suitable thermal and material properties. The circuit board may have a ceramic base for high voltage and high temperature applications or may have a plastic base for chemical resistance. Flexible board layers and flexible cores may be used where flexing is needed in a multilayer circuit board constructed as a transformer. The multilayered circuit board can be made in any desired shape and can equate to any current transformer design.

The structure of the multilayered circuit board of the present invention allows the creation of transformers that use sheets of ceramic embedded with copper to construct windings around a high efficiency core. The core can be micrometal, proven to increase power transfer efficiency at significantly lower temperatures, compared to existing transformers. The windings can be of the same square area as currently used wire but of rectangular geometry, allowing higher coil density. The ceramic can be significantly thicker than the current thin insulation coatings, but will eliminate paper or other spacers used to separate layers in the transformers. This multilayered circuit board will allow creation of smaller transformers with a more rugged design, providing higher allowable temperatures for emergencies, less maintenance (no fluids), less environmental impact, and longer life.

With respect to the above description then, it is to be realized that the optimum dimensional relationships for the parts of the invention, to include variations in size, materials, shape, form, function and manner of operation, assembly and use, are deemed readily apparent and obvious to one of ordinary skill in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those of ordinary skill in the art, it is not desired to limit the invention to the exact construction and operation shown and described, and accordingly, all suitable modifications and equivalents may be resorted to, falling within the scope of the invention.

The invention claimed is:

1. A multilayered printed circuit board having circuit trace windings, comprising:

a) two or more top layers, two or more bottom layers and, one or more intermediate layers therebetween;

b) each said intermediate layer has an open interior so that said two or more top layers, said two or more bottom layers, and said intermediate layers form a hollow interior within said multilayered printed circuit board;

c) each of said two or more top layers, two or more bottom layers, and one or more intermediate layers having a plurality of electrically conducting holes wherein, when one said electrically conducting hole contacts another said electrically conducting hole, an electrical conducting connection is made therebetween;

d) electrical circuit traces on said two or more top layers and said two or more bottom layers wherein said electrical circuit traces connect one electrically conducting hole to another electrically conducting hole, wherein said electrical circuit traces form connections across said two or more top layers and said two or more bottom layers, and wherein said electrically conducting holes form electrical connections between said two or more top layers, said intermediate layers, and said two or more bottom layers, thereby forming two or more sets of wireless windings around said hollow interior; and e) said one or more intermediate layers having no said electrical circuit traces.

2. The multilayered printed circuit board of claim 1 wherein each set of wireless windings has its own top layer and bottom layer.

3. The multilayered printed circuit board of claim 2 further comprising a metal core in said hollow interior.

4. The multilayered printed circuit board of claim 1 further comprising one or more taps extending from one or more said conducting holes or from one or more said electrical circuit traces.

5. The multilayered printed circuit board of claim 1 further comprising said two or more sets of wireless windings being connected in series.

6. The multilayered printed circuit board of claim 3 further comprising said metal core being completely embedded within said multilayered printed circuit board.

7. The multilayered printed circuit board of claim 3 further comprising said multilayered printed circuit board having a circular shape and said metal core having a circular shape.

8. A transformer comprising:

a) a multilayered printed circuit board of claim 3; and b) at least one set of primary windings and at least one set of secondary windings around said metal core.

9. The transformer of claim 8 further comprising one or more taps extending from one or more said conducting holes or from one or more said electrical circuit traces.

10. A transformer comprising:

a) a multilayered printed circuit board of claim 7; and b) at least one sets of primary windings and at least one sets of secondary windings around said metal core.

11. The transformer of claim 10 further comprising one or more taps extending from one or more said conducting holes or from one or more said electrical circuit traces.

12. A transformer comprising:

a) two multilayered printed circuit boards of claim 1;

b) each said multilayered printed circuit board having a metal core in said hollow interior;

c) one of said multilayered printed circuit boards having at least one set of primary windings around its metal core and a second of said multilayered printed circuit boards having at least one set of secondary windings around its metal core; and d) said metal cores being connected to form a continuous core.

13. The transformer of claim 12 further comprising one or more taps extending from one or more said conducting holes or from one or more said electrical circuit traces.

* * * * *